US009489805B2

(12) United States Patent
Amaitis et al.

(10) Patent No.: US 9,489,805 B2
(45) Date of Patent: Nov. 8, 2016

(54) MULTI-LEVEL WAGERING COMPETITIONS

(71) Applicant: CFPH, LLC, New York, NY (US)

(72) Inventors: Lee Amaitis, Las Vegas, NV (US); Kenneth L Miller, Ankeny, IA (US); Jason Simbal, Las Vegas, NV (US); Craig Lipka, Cresskill, NJ (US); Phillip Flaherty, Las Vegas, NV (US)

(73) Assignee: CFPH, LLC, New York, NY (US)

( * ) Notice: Subject to any disclaimer, the term of this patent is extended or adjusted under 35 U.S.C. 154(b) by 0 days.

(21) Appl. No.: 13/790,200

(22) Filed: Mar. 8, 2013

(65) Prior Publication Data

US 2013/0260847 A1 Oct. 3, 2013

Related U.S. Application Data

(60) Provisional application No. 61/618,182, filed on Mar. 30, 2012, provisional application No. 61/715,972, filed on Oct. 19, 2012, provisional application No. 61/721,181, filed on Nov. 1, 2012.

(51) Int. Cl.
*G07F 17/32* (2006.01)

(52) U.S. Cl.
CPC ..... *G07F 17/3272* (2013.01); *G07F 17/3276* (2013.01)

(58) Field of Classification Search
USPC ..... 463/3, 5, 6, 7
See application file for complete search history.

(56) References Cited

U.S. PATENT DOCUMENTS

| | | | | |
|---|---|---|---|---|
| 7,637,810 | B2 * | 12/2009 | Amaitis et al. | 463/25 |
| 2001/0003099 | A1 | 6/2001 | Von Kohom | |
| 2001/0004609 | A1 | 6/2001 | Walker et al. | |
| 2002/0058548 | A1 | 5/2002 | Stronach | |
| 2007/0167210 | A1 | 7/2007 | Kelly et al. | |
| 2008/0182644 | A1 * | 7/2008 | Lutnick et al. | 463/20 |
| 2008/0274782 | A1 * | 11/2008 | Schmidt | 463/13 |
| 2009/0005175 | A1 | 1/2009 | Rosenau et al. | |
| 2011/0053681 | A1 * | 3/2011 | Goldman et al. | 463/25 |
| 2011/0053712 | A1 | 3/2011 | Maul | |

FOREIGN PATENT DOCUMENTS

WO WO 2006/127801 11/2006

OTHER PUBLICATIONS

Notification of Transmittal of the International Search Report and the Written Opinion of the International Searching Authority for International Application No. PCT/US13/29797 mailed May 21, 2013, 9 pages.

Australian Examination Report for Application No. 2013240404 dated Apr. 4, 2016 (3 pages).

* cited by examiner

*Primary Examiner* — Paul A D'Agostino
*Assistant Examiner* — Brandon Gray
(74) *Attorney, Agent, or Firm* — Mark Miller

(57) ABSTRACT

Various embodiments that may generally relate to one or more competitions. Such competitions may include a plurality of rounds. A round may include a player attempting to choose a winner of an event on which a round is based. A surviving player after a number of rounds may be a winner of a competition. Various apparatus and methods are described.

24 Claims, 4 Drawing Sheets

MULTI-LEVEL WAGERING COMPETITIONS

CROSS REFERENCE TO RELATED APPLICATIONS

This application is a non-provisional of U.S. provisional applications 61/721,181 filed Nov. 1, 2012; 61/715,972 filed Oct. 19, 2012; and 61/618,182 filed Mar. 30, 2012, all of which are hereby incorporated herein by reference.

FIELD

Some embodiments may generally relate to competitions.

BACKGROUND

Gaming may include risking an amount of money that one event will or will not happen. Various events, such as horse races, other sporting events, casino games, non-sporting events, and so on may form the basis of a game.

SUMMARY

The following should be understood as example embodiments, and not as claims.

A. A method comprising: accepting, by a computing device, bets from a first set of players to enter a competition that includes a maximum number of rounds; conducting, by the computing device, successive rounds of the competition by, for each round by: accepting, from remaining players in the competition, a respective choice of a respective winning participant of a respective event on which a respective round is based, stopping acceptance of said choices from said remaining players at some point between a start of and an end of the respective event, and determining one or more successful players to be those one or more players that correctly chose a winner of the respective event, in which conducting the successive rounds includes continuing to conduct said successive rounds until at least one of: no players successfully choose a winner, only one player successfully chooses a winner, and the maximum number of rounds have been completed, and eliminating players from subsequent rounds of the successive rounds that did not successfully choose a winner; and awarding, by the computing device, a respective one of: players that successfully chose a winner of a prior to final successive round, the one player, and the remaining players after the maximum number of rounds have been completed.

A.1. The method of claim A, in which accepting bets includes accepting buy ins into the competition. A.2. The method of claim A, comprising: allowing a player that has been eliminated from a prior round to buy into a later round by placing another bet. A.3. The method of claim A, comprising: determining an event for each round by selecting a recorded event from a library of recorded events. A.4. The method of claim A, in which selecting a recorded event includes determining desired difficulty level for a respective round and choosing a recorded event that has been tagged with that difficulty level. A.5. The method of claim A, in which each event includes a race. A.6. The method of claim A, in which each event includes a portion of a single race. A.7. The method of claim A, in which accepting a respective choice includes pausing a presentation of a respective event for a period of time so that players may enter choices and in which stopping acceptance includes resuming the presentation. A.8. The method of claim A, in which conducting successive rounds includes displaying an initial portion of a respective event prior to accepting the respective choices. A.9. The method of claim A, comprising pooling the bets together and awarding from the pool.

B. A method comprising: accepting, by a computing device, buy-ins to a competition from each of a plurality of players; for a first player in a first round, determining, by the computing device, a recorded first event that is stored in an event library and is tagged with a difficulty level associated with the first round; for a second player in the first round, determining, by the computing device, a recorded second event that is stored in the event library and is tagged with the difficulty level; presenting, by the computing device, a first portion of the first event to the first player and a first portion of the second event to the second player; receiving, by the computing device, a first selection of a winner in the first event from the first player and a second selection of a winner in the second event from the second player; and determining, by the computing device, whether the first player advances to a second round of the competition depending on whether the first selection is correct based on a second portion of the first event and whether the second player advances to a second round of the competition depending on whether the second selection is correct based on a second portion of the second event.

B.1. The method of claim B, comprising: tagging each event in the event library with a difficulty level based on a closeness of event partisans at the end of respective first portions of each event. B.2. The method of claim B, comprising: presenting the second portion of the first event to the first player and the second portion of the second event to the second player. B.2.1. The method of claim B.2, comprising: pausing the presentations of each of the first event and the second event between respective first portions and second portions, and requiring that the first play make the first selection while the presentation is paused and that the second player make the second selection while the presentation is paused. B.2.2. The method of claim B, in which the respective second portions are presented in response to receiving respective selections. B.3. The method of claim B, in which the first and second event include respective horse races. B.4. The method of claim B, comprising: obscuring presentation of the first portion of the first event and the first portion of the second event. B.4.1. The method of claim B.4, in which obscuring includes at least one of making an adjustment to a recording, a change to a color in a recording, and a change to a sound in a recording. B.5. The method of claim B, comprising: determining that the first and second players are in the same competition based on when a buy in is received from each of the first player and the second player so that the players are in the competition in response to submitting buy-ins at a similar time.

C. An apparatus comprising: a computing device; and a non-transitory medium having stored thereon a plurality of instructions that cause the apparatus to: accept bets from a first set of players to enter a competition that includes a maximum number of rounds; conduct successive rounds of the competition by, for each round by: accepting, from remaining players in the competition, a respective choice of a respective winning participant of a respective event on which a respective round is based, stopping acceptance of said choices from said remaining players at some point between a start of and an end of the respective event; and determining one or more successful players to be those one or more players that correctly chose a winner of the respective event, in which conducting the successive rounds includes continuing to conduct said successive rounds until at least one of: no players successfully choose a winner, only one player successfully chooses a winner, and the maximum number of rounds have been completed, and eliminating players from subsequent rounds of the successive rounds that did not successfully choose a winner; and award a respective one of: players that successfully chose a winner of a prior to final successive round, the one player, and the remaining players after the maximum number of rounds have been completed.

D. An apparatus comprising: a computing device; and a non-transitory medium having stored thereon a plurality of instructions that cause the apparatus to: accept buy-ins to a competition from each of a plurality of players; for a first player in a first round, determine a recorded first event that is stored in an event library and is tagged with a difficulty level associated with the first round; for a second player in the first round, determine a recorded second event that is stored in the event library and is tagged with the difficulty level; present a first portion of the first event to the first player and a first portion of the second event to the second player; receive a first selection of a winner in the first event from the first player and a second selection of a winner in the second event from the second player; and determine whether the first player advances to a second round of the competition depending on whether the first selection is correct based on a second portion of the first event and whether the second player advances to a second round of the competition depending on whether the second selection is correct based on a second portion of the second event.

DETAILED DESCRIPTION

I. Example Embodiments

Figure 1:
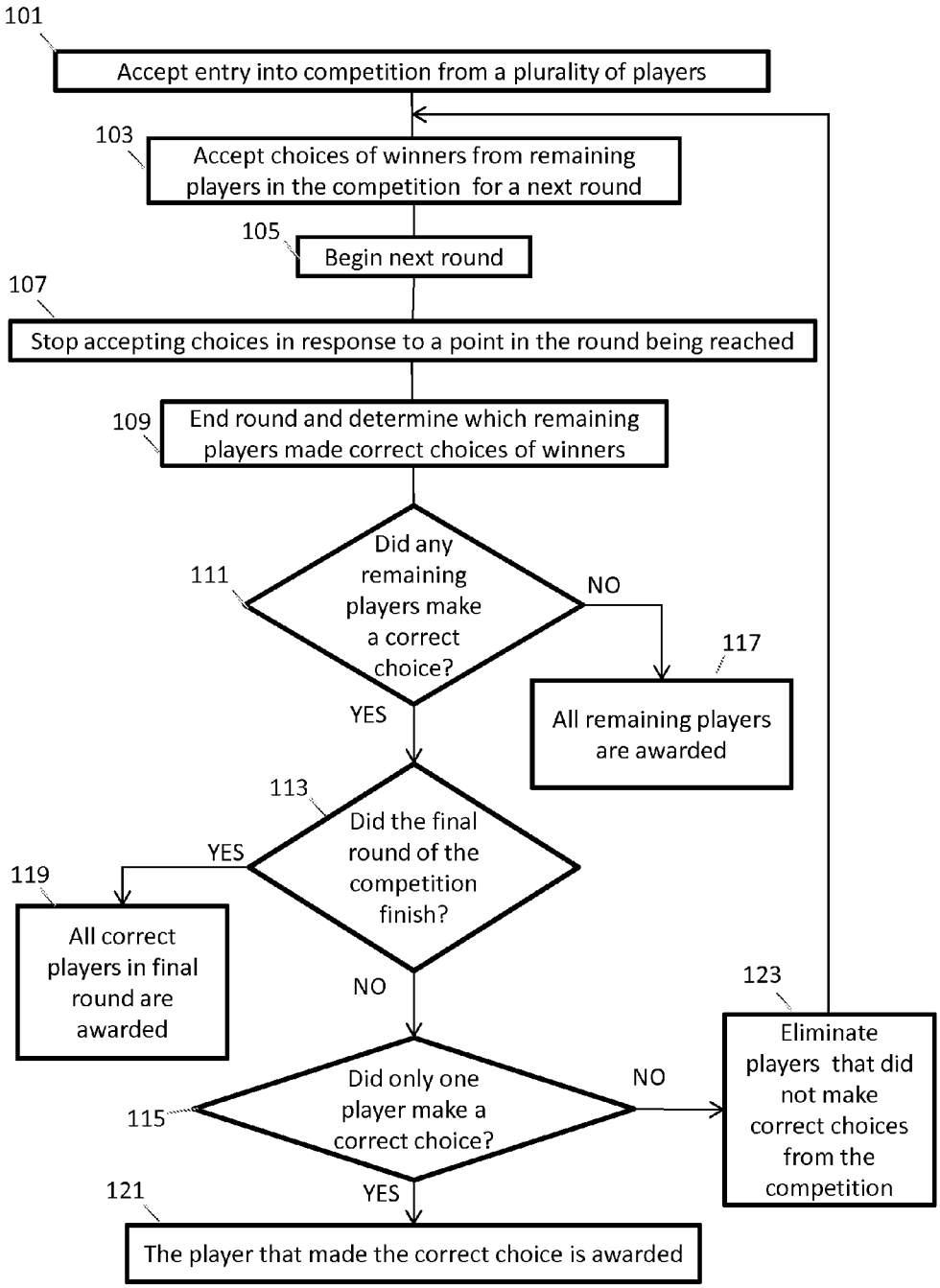
FIG. 1 shows an example method that may be performed in some embodiment.

Colloquially, gaming may be referred to as wagering but it should be understood that embodiments are not limited to the statutory definition of wagering that is limited to games of chance but rather may include games of skill, fantasy games, games of chance, and/or any other type of games, and therefore the term gaming may be used when discussing some embodiments rather than the term wagering. Gaming may include a risk of an amount of money that some event will happen. Such risk may be skill and/or risk based, booked and/or pari-mutuel, and/or take any form desired. Gaming may include paying a fee to enter into a contest that is based on the occurrence of an event. The winner of such a contest may be provided with an award (e.g., money based on a sum of contest entry fees). Wagering may be used herein to refer to such skill or risk based gaming in some instances and should not be understood to be limited to one or the other type of gaming unless specified otherwise. Gaming may include wagering, betting, risking money, paying an entry fee to a contest, and/or any other form of gaming as desired. Various embodiments may apply to any type of gaming in any combination and/or arrangement.

Some embodiments may facilitate gaming related to an outcome of a plurality of events. In some embodiments, one or more events may be arranged into a round of a multi-level competition. Some embodiments may allow a plurality of players to play against one another over a plurality of levels of a multi-level competition. In some embodiments, success at a lower level may allow a player to move to a next level of a multi-level competition. In some embodiments, failure at a level may remove a player from a multi-level competition. A winner may be determined based on a surviving player(s) in the competition.

Although some examples herein may be given in terms of a horse racing environment and waging on horse races, it should be recognized that such an environment is given as a non-limiting example only. Various embodiments may include any types of events, such as political events, casino games, sporting events, card games, board games, reality show outcomes, fantasy games, and so on.

Some embodiments may include a gaming provider. A gaming provider may include a casinos, a sports book, a horse racing establishment, a totalizer, and so on. A gaming provider may include one or more computing devices that may accept money risked in a game, accept contest entry fees, form wagers, audit events, verify users, determine outcomes, track results, receive information, maintain account information, transmit information, maintain pari-mutuel pools, determine odds, and/or perform any desired actions. Such a computing device may include a server operated on behalf of a gaming provider.

Some embodiments may include one or more user devices. Such devices may allow users to interface with a gaming operator to take game actions (e.g., place a wager), play games, view information about games, access account information, view results, make race winner selections, and so on. Such user devices may include smart phones, cell phones, tablets, personal computers, kiosks, devices operated by gaming provider personnel, and so on.

FIG. 1 illustrates an example method that may be performed in some embodiments. It should be recognized that this example method is given as a non-limiting example only. Other embodiments may include no method, a different method, a different ordered method, a method with alternative actions, a method with different actions, a method with additional actions, and so on. Such a method may be performed by a gaming operator, some component thereof, and/or any desired entity alone or in combination with any other entity.

Some embodiments may include opening gaming in a competition. For example, FIG. 1 at block 101 illustrates an example opening of gaming that includes accepting wagers for entry into a competition from a plurality of players. Opening gaming may include determining events for the competition, allowing players to put money at risk to enter them into the competition, tracking games and/or game actions made in the competition, allowing users to access information and/or take actions related to the competition, and so on. For example, in some embodiments, a gaming operator may determine that horse races run at a track for a day, month, week, and/or other time period, run at a setoff tracks, previously run, a number that will be run, no limit or bounds but just races that will be run in the future, and so on may be part of a competition and may begin to accept money from users to enter that competition.

A computing device of a gaming provider may determine that risks of money and/or other game actions on a first competition should be accepted and may store information about such money and/or other actions and the competition (e.g., determining events that are part of the competition, database entries identifying which players have entered into the competition, audit information identifying parameters of a pari-mutuel pool, choices of winners in the competition, and so on). User devices may be controlled to display gaming options for the competition (e.g., a button or other control may be enabled and/or displayed in a user interface that allows a player to take a gaming action in the competition, make a choice of a winner in a round of the competition, and so on). It should be recognized that any desired action may be taken to begin gaming related to a competition (e.g., displaying information to users, identifying rules to users, accepting money from users, advertising to users, storing audit information, determining events to include in the competition, determining parameters of the competition, determining eligibility for the competition, and so on)

Some embodiments may include accepting one or more entries into a competition. For example, a player may give money to a gaming provider to enter a competition (e.g., move funds from an electronic gaming account, deposit money to a gaming provider, place a wager, etc.) to enter a competition. Entry into a competition may include paying or otherwise risking a fixed amount that may be common to all players in a competition (e.g., 1$ buys entry into the competition, 10$, etc.). Paying such a fee and/or otherwise risking such n amount of money may include a variable amount that a player chooses and that may affect an amount won by the player if the player wins the competition (e.g., a player may win a portion of a pari-mutuel pool that is in some way proportional to an amount paid). Information regarding the buy-ins to a competition may be stored by a computing device of a gaming operator, for example, for auditing purposes and/or to aid in the facilitation of a competition.

In some embodiments, in response to receiving an entry in to a competition, a player may be given access to functionality that allows the player to take part in the competition and/or view information about the competition. In some embodiments, such information and/or functionality may otherwise be denied a player. For example, a player may be granted access to a user interface through which the player may select a winner of an upcoming event (e.g., round of the competition).

Some embodiments may include accepting choices of winners from one or more players for a first round of a competition. Block 103 illustrates an example of this occurring in FIG. 1. For example, at block 103, all players that are remaining in a competition for a current round of the competition may be allowed to submit a choice of a winner for the round of a competition. In some embodiments, choices may be accepted by a gaming operator only before a round of the competition begins. In some embodiments, choices may be accepted by a gaming operator only after a round of the competition begins. In some embodiments, choices may be accepted by a gaming operator before and after a round of the competition begins. Each player in a round of a competition may submit such a selection and/or may be required to submit such a selection to have a chance of moving on to a next round of the competition.

Choosing a winner may include selecting a horse from among the participating horses in an event, choosing a group of horses from amount a set of groups of horses that participate in the event such that any one may win, choosing a number of horses from among the participating horses such that any one may win, choosing any participant, set of participants, group of participants, teams, and so on that may win an event, and so on.

It should be recognized that although various examples are given in terms of choosing a winner, that these examples are non-limiting. For example, some embodiments may include choosing losers, choosing any particular place and a particular participant that will end in that place (e.g., horse four will end in fourth place), a particular ordering of participants, and/or any characteristic that may be judged at an end of a round.

Some embodiments may include receiving a choice of a winner in a round (e.g., event) of a competition. For example, in some embodiments, a player may be presented with a user interface of a user device listing options for choosing a winner of a round of the competition. Such a user interface may, for instance, list available winners and allow a player to choose from among those available winners (e.g., a single possibility, some maximum numbers hoping that one out of that number will win, a prearranged group of possible winners hoping that one of that group will win, and so on). A player may select the one or more winners and submit that information through the user device to a gaming operator (e.g., transmit through a communication network). The gaming operator may receive that information and may store and/or otherwise analyze it as desired to determine outcomes of a round of a competition and/or a competition as a whole. It should be recognized that operation of choosing one or more winners, receiving information, processing information, and/or user interfaces are given as non-limiting examples only.

In some embodiments, winners may be required to be selected by a player in the competition during a defined period (e.g., before a beginning of a round, before a certain point in the round, before an end of a round, after a start of a round, and so on). In some embodiments, if a choice is not received and/or submitted by a player in that period, the player may be treated as having lost in the round, may be ineligible for winning a tournament, may be given a chance to make up the lack of submission, and so on. For example, in some embodiments, a player that does not submit a winning choice for a round may be treated as having chosen a losing participant in the round.

Some embodiments may include beginning a first round of a competition (e.g., an event on which players make choices of winners). Block 105 illustrates an example of this in FIG. 1. For example, in some embodiments a horse race will be started. In some embodiments, a horse race may be started by a gaming operator (e.g., by signaling that gates should be opened, by signaling to jockeys that a race has begun, by playing a prerecorded video of a horse race, by playing a virtual representation of a horse race, etc.). It should be recognized that there are any number of ways in which an event may be started that may or may not be in response to competition-related events. In some embodiments, players may be notified of a start and/or upcoming start of an event related to the competition (e.g., notified of a time and/or location of the event, given directions to the event, shown a video display of the event, shown a countdown related to the start of the event, shown a beginning portion of an event that is paused to accept winner choices, solicited for a choice of winners, and so on).

In some embodiments, a period during which a bet to enter the competition may be made may end at a start of a first round. In some embodiments, a period during which a choice of a winner may be made for the round may end at the start of the round. In some embodiments, a period during which a choice of a winner may be made may begin at a start of a first round. Information about the first round beginning may be collected by a gaming operator (e.g., through use of an electronic system that monitors events of a race or other event, through entry of information by a user, through reading in a data feed of information, and so on.

Some embodiments may include determining that a point in the first round has been reached that is relevant to the competition. For example, a point may include a midway point, a lead horse reaching a certain location on a track, a certain amount of time passing from the start of the race, an amount of points being earned, a point difference being greater than an amount, a first portion of a recording of an event having been shown, and so on. Such point being reached may trigger one or more actions. Determining that such a point is reached may be made in response to information that may be collected and/or analyzed by a gaming operator (e.g., a data feed describing an event, entry of information about the event into a computer interface by a person watching the event, an electronic event tracking system, and so on).

In response to determining that a threshold point in a first round is reached, a window during which players may select winners for the first round may be closed. Block 107 of FIG. 1 illustrates an example of this occurring. For example, a gaming operator may stop accepting choices of winners from the players that remain in the competition in response to the threshold point being reached. In other embodiments, such choices may be received up until an end of an event, until a beginning of an event, and so on.

In some embodiments, a display of a portion of an event may be made and then paused to open a winner selection window. The pause may take some period of time (e.g., 1 minute, 30 seconds, 5 minutes, etc.). When that period of time has passed, the winner selection window may be determined to have ended. A player in the competition may be required to choose a winner before the pause period ends. In some embodiments, the player may be able to choose the winner before the pause period and/or there may be no pause period at all. After the pause period, a remainder of the event may be displayed and may form the basis of a determination of the winner. Accordingly, a threshold point may not necessarily be the point of the event itself, but may be some related point, such as 30 seconds after the point is reached when a pause period ahs ended.

In some embodiments, a window for accepting money to enter the competition may be closed in response to the threshold point being reached. In other embodiments such a point may be unrelated to such entry into the competition. A different point may be used for different actions and/or different competitions that may involve a same event (e.g., one competition may use a first point to close a window and a second competition that uses an overlapping event may use a different point), and payment to enter either competition may end at yet a third point that may be before or after either of the other two points).

It should be recognized that examples of points in a round and/or actions related to those points are given as examples only and are not limiting in any manner. For example, any point before, during, or after may be used in various embodiments and may be same or different for different rounds and/or different competitions. Such points may be coupled with pause points (e.g., in video wagering environments) and/or not so related (e.g., in live on site environments).

In some embodiments, a round may end and one or more successes may be determined for the round as indicated at block 109. For example, a round may end when an event associated with the round ends (e.g., when a winner of an event is determined, when all participants of the event finish, and so on). Successes for a round of a competition may be determined based on matches between chosen winners (e.g., block 103) and actual winners of a round. For example, if a player chose horse 4 to win a round, and horse 4 wins the round, then the player may be a success for that round. Conversely, if a player chose horse 4 to win a round and horse 4 does not win the round, then the player may not be a success for that round. Determinations may be made for each player as to whether that player is a success for a round or not based on a comparison of a choice made for a winner of that round and an actual winner of that round.

In some embodiments, depending on the circumstances of a competition and successes in a round of the competition, various actions may be taken, as indicated by decision blocks 111, 113, and 115.

For example, some embodiments may include determining whether any remaining players in a competition successfully finished a round of the competition. Such a determination may include determining whether the number of successes determined at block 109 is at least one (e.g., did at least one player in the competition choose a correct winner of the round, or some other number that is desired to be a number of finalists).

As indicated in block 117, an action may be taken if there are no successes from a round (e.g., in response to a determination that no remaining players made a correct choice in a round of a competition). One example illustrated action may include awarding all of the players that remained in the competition at the time of the round that resulted in no successes. For example, if two players remained in a competition at a time of a round and neither of them chooses a correct winner for that round, both players may be awarded in some manner. Those awarded players may be considered winners of the competition. Various examples of awards and/or winning may be described elsewhere herein.

As another example action that may be taken in some embodiments, that is not illustrated in FIG. 1, some embodiments may include performing a further round of the competition involving the players that participated in the prior round of the competition (e.g., if two players did not choose winning horses in a round of a competition, those two players may be allowed to choose horses for another round of the competition). Such a subsequent round may act as a redo of a prior round. In some embodiments, some maximum number of redos may be allowed. For example, a maximum number of total rounds may be allowed and there may be redos allowed until that number is reached. If a maximum is reached, remaining players may be treated as winners and/or losers of the competition as desired and based on the rules of the competition.

In some embodiments, as indicated in FIG. 1, an action may be taken if there are one or more successes from a round (e.g., in response to a determination that at least one remaining players made a correct choice in a round of a competition).

One example illustrated action may making a determination of whether the round is a final round of a competition as indicated at block 113. Such a determination may amount to a determination of whether the competition has ended. For example, some competitions may be limited to a maximum number of rounds (e.g., the rounds on a particular day, n rounds from a start of the competition, and so on).

It should be recognized that a maximum number of rounds and that a last round being a round when the maximum is reached is given as an example only. For example, some embodiments may not be limited to a maximum number of rounds. Such embodiments may continue for example until some other ending criterion is reached (e.g., only one player remains in the competition, no players choose a correct winner for a round of a competition, and so on).

As indicated in block 119, an action may be taken if a final round has finished (e.g., in response to a determination that a final round has finished and/or one or more remaining players made a correct choice in the final round) One example illustrated action may include awarding all of the players that remained in the competition at the time of the final round. Those awarded players may be considered winners of the competition. Various examples of awards and/or winning may be described elsewhere herein.

In some embodiments, as indicated in FIG. 1, an action may be taken if the round is not the final round (e.g., in response to a determination that the round is not the highest numbered round allowed in a competition, in response to at least one remaining players made a correct choice in the round of a competition).

One example illustrated action may making a determination of whether only one player made a correct choice in the round of the competition as illustrated in block 115. For example, such a determination may include counting the number of players that made a correct choice to determine if that number is greater than one. It should be recognized that one is given as a non-limiting example only and that some embodiments may include any number of players (e.g., five, two, ten, and so on).

As indicated in block 121, an action may be taken if there is only one player that made a correct choice (e.g., in response to a determination that only one player made a correct choice). One example illustrated action may include awarding the player that made the correct choice. For example, if two players remained in a competition at a time of a round and only one made a correct choice, then the one player may be awarded in some manner. The awarded player may be considered a winner of the competition. Various examples of awards and/or winning may be described elsewhere herein.

As a non-illustrated example, some embodiments may continue the competition and/or require some round of the competition to be completed by the player. For example, a player may not be considered a winner and/or awarded unless the player successfully completes a minimum number of rounds of the competition (e.g., same or different from the maximum number of rounds that may be included in some embodiments).

As another non-illustrated example, the player may be allowed but not required to continue to choose winners in subsequent rounds (e.g., for an added bonus). For example, a player may be awarded and/or allowed to accept an award for being the only successful player in the competition. The player may be allowed to forego that award and/or augment that award by continuing to choose winners in subsequent events. For example, for each subsequent success (e.g., up to a maximum or with no maximum), an extra award may be added (e.g., an award may be doubled for the player, a greater portion of a pool may be awarded up to a full pool when a number of successes has been reached, etc.). If the player fails to make a correct choice in such subsequent event, the player may be left with no award in some implementation (e.g., the player may risk a lower award for a higher award amount from a subsequent round). In other embodiments, if a player fails to make a correct choice in such a subsequent event, the player may be given some award (e.g., an original award for winning the competition, an award amount from a prior subsequent round after winning the competition, a buy-in amount, some other amount, etc.). Running such a subsequent round may be similar to running a round of the competition when other players are remaining (e.g., accepting choices during the event, treating a failure to make a choice as an incorrect choice, etc.) and/or differently than such rounds as desired.

As indicated in block 123, an action may be taken if there is more than one player that made a correct choice (e.g., in response to a determination that more than one player made a correct choice, in response to a determination that the round is not a final maximum round of the competition, one player is again given as an example only). One example illustrated action may include eliminating players from the competition that did not make a correct choice in the round. For example, each player that did not make a correct choice in the round may be eliminated from future rounds of the competition. Such players may be considered losers of the competition. In some instances there may be no players to eliminate if all players made a correct choice in a round.

It should be recognized that elimination of players that did not make correct choices is a non-limiting example only. For example, in some embodiments, players that made incorrect choices may be eliminated (e.g., allowing players that made no choices to continue on). For example, in some embodiments, a player may be able to skip some number of rounds of the competition without being eliminated from the competition (e.g., if they are unsure of a particular round they may skip it and stay in the competition for a next round). As another example alternative, some embodiments may allow a player to make some number of incorrect choices and stay in a competition (e.g., each player may be given a single incorrect choice and stay in the competition), and accordingly may include eliminating players that made more than that allowed number f incorrect choices from the competition.

Some embodiments may include looping back to play another round of a competition. For example, as illustrated in FIG. 1, after eliminating players from the competition, a method may loop back to block 103 to accept choices from remaining players in the competition for a next round of the competition. The round of the competition may be for a same event or different event as prior rounds of the competition. The round of the competition may proceed similarly or differently than the previously described round of the competition. For example, some embodiments may include accepting choices, beginning a round, ending the round, determining which players made correct choices in the round, performing different actions based on the situation at the end of the round and/or a number of players that made a correct choice in the round. Any number of rounds whether limited or not may continue until a maximum number of round (if applicable) is reached, no players make a correct choice in a round, only one player make a correct choice (or otherwise would remain in the competition after a round), and/or any other desired competition ending criterion is reached.

It should be recognized that accepting choice and performing rounds in sequence looping as illustrated in FIG. 1 is given as a non-limiting example only. For example, in some embodiments one round may overlap with another round. A prior round in the competition may be chosen as a prior round even if it starts, occurs, ends or so on after a later round in the competition. For example, players may make choices for the rounds at a same time (e.g., all rounds of the competition, some set of rounds of the competition) so that elimination may occur as desired regardless of the order of the rounds actually being run, finished, started, etc. As another example, rounds may include prerecorded rounds that may be randomized to prevent cheating rather than live events.

As another example, players may not play rounds that are based on the same event or even events that occur at the same time, but rather may choose winners in different events from one another and/or at different times and/or for events that occur and/or are displayed at different times from one another. Nonetheless, such players may still engage in play together in the competition. Each play choice may be tracked as part of a particular round in the competition even if they occur at different times. Accordingly, in some embodiments, a player may end up winning a competition and may not be aware of that win until other players lose the competition through rounds of the competition that occur after in time from the round of the competition that results in the player winning the competition.

It should be recognized that FIG. 1 is illustrated as a non-limiting example only. Other embodiments may include alternative, different, same, more, fewer, differently ordered, none, all, and so on of the actions as illustrated in FIG. 1. For example, decision making and/or elimination in blocks 111, 113, 115, 123 may take place simultaneously, in a different sequence and so on.

According to some embodiments that may include a method such as that illustrated in FIG. 1, players may enter into a competition that includes multiple rounds of choice making. Choice making may take place for a round during an event that the round is based on. Incorrect choices may result in elimination of a player. A player may win the competition by surviving to an end round and/or being a last player remaining in the competition. Accordingly, at a start of a competition, a player may not know how long a competition will last. Accordingly, a player may enter into a competition for choosing the most number of consecutive winners of an event (e.g., a race) that includes multiple (e.g., two, more than two) participants.

Some embodiments may include awarding one or more winners. For example, a winner may be awarded with a monetary prize, a non-monetary prize, recognition, an ability to take some action, and so on.

In some embodiments, money risked and/or otherwise paid to enter the competition may be pooled together in a pari-mutuel pool. In some embodiments, one or more winners of the competition may be awarded from the pari-mutuel pool. For example, each winner of the competition may receive a portion of the pari-mutuel pool that is proportional to an amount spent to enter the competition. In an embodiment where entry amounts are equal (e.g., there is one buy in or ante amount for the competition), for example, winners may receive equal portions. In an embodiment where entry amounts may differ, a winner that paid a large amount to enter the competition may receive a larger portion of the pool than a winner that paid a smaller amount to enter the competition.

In some embodiments money spent to enter the competition may include booked bets rather than and/or in addition to pari-mutuel bets. For example, such a money spent may be spent with a sports book. Such a booked bet may include odds and/or other characteristics that may be defined by the sports book and/or other gaming operator (e.g., 2-1 odds, 10-1 odds, 100-1 odds, etc.).

Awarding a player may include adjusting an account balance of a gaming account, providing money to the player, and so on. For example, in some embodiments, a gaming account from which the user risked money on the competition (e.g., through an electronic device such as a kiosk, a mobile device, and so on) may be adjusted to include a payout in response to the winner winning the competition. In some embodiments, a winner may present a physical ticket to a teller to receive a physical cash payout.

In various embodiments, any desired type of payout or award may be provided whether pari-mutuel, booked, or other wise and it should be recognized that these examples of awarding winners are non-limiting.

Some embodiments may include providing a second chance to a loser to continue playing in a competition. For example, some embodiments may provide one or more second place finishers of the competition with an award. Such an award may include a smaller award than the winner's award (e.g., 10% of such an award). In some embodiments, a second chance may allow a player to buy back into a competition (e.g., pay some fee that may be greater than, equal to or less than an original buy-in to prevent elimination from the competition). Such a buy-back in amount may only be available early in the competition and/or later in the competition. Such a buy-back in amount may increase as the competition goes on.

Some embodiments may include running a second competition that begins at a later time than the first competition or losers of the first competition. For example, a last n (e.g., 5) races may be a separate competition in which losers of the competition may take part (e.g., may not have to pay, may be allowed to pay, may be exclusive for those losers, etc.). The second competition may overlap with the competition (e.g., the competition may last for all races of the day and the second competition may be for the last n races of the day so the last n races may overlap). Accordingly, a loser in one of the overlapping races may or may not be able to take part in the second competition. For example, a loser in the second to last race of the day may take place in the second competition as if they had won prior rounds of the second competition up to the final round of the second competition. In other embodiments, entry into the second competition may be cut off at the start of the second competition. A second competition may be run substantially similarly to the competition described above. Such a second competition may include all losers of the first competition and/or a mix of losers and new players that were not in the first competition. Some or all entrants may be required to pay a fee that may or may not depend on their status as a loser of the first competition (e.g., losers get in free or with a reduced bet than new players). A gaming operator may offer and/or track progress and/or entry into the second competition in response to actions and/or outcomes in the competition to offer losers of the competition (e.g., losers that reach some point in the competition) with a chance to continue playing.

Some embodiments may allow a player to surrender in the middle of a competition. For example, if a player reaches a second to last round of the competition, the player may take some award to forego a chance of winning the competition. Such an award may be determined based on a size of a potential award for winning, a number of players remaining in the competition, and/or an odds of the player winning the competition. For example, a gaming operator may offer the player 90%, 110%, etc. of the expected value of staying in the competition to surrender now.

It should be recognized that while some embodiments are given in terms of taking gaming actions before a competition or round of the competition, such examples are non-limiting. For example, some embodiments may include allowing players to enter the competition by risking money during a first and/or subsequent round of the competition (e.g., before a cutoff for choosing a winner for the first round). As an example of entering at a subsequent round, a player may pay some additional fee to enter the competition at a later round than the first round. Such a fee may be determined by a gaming operator and/or may be based on an expected advantage that a player gets for entering at a later round (e.g., may increase as rounds progress and/or other players lose).

Some embodiments may include events that are live events and/or at a single gaming venue. For example, some embodiments may include a competition that relates to races on a day or weekend at a single race track. As another example, some embodiments may include rounds that relate to innings of a baseball game played at a single stadium (e.g., each round may relate to who scores more points in an inning, what events occur in the inning, etc.). Such events may include live events that may take place contemporaneously with such a competition. Such examples are non-limiting.

Some embodiments may include events that are not live and/or not at a single gaming venue (e.g., race track). For example, some embodiments may include a competition that involves events from multiple venues (e.g., a competition that includes races from multiple race tracks, multiple stadiums, etc.). Some embodiments may include events that are not live events and/or contemporaneous events with the competition. For example, some embodiments may include choosing prerecorded events and presenting them as events in the competition (e.g., playing portions of the events through a display device).

Although some embodiments have been described as including a single set of events for a competition that relates to all users, such examples are non-limiting. For example, some embodiments may include a different set of events for at least some different players. For example, a player at one venue may enter the competition related to events at that venue and a player at another venue may enter the competition with events that are at that venue. As another example, different prerecorded events may be displayed to different players. Nonetheless, the competition may be the same and may relate to a same pool and/or winning conditions.

In some embodiments, players may use mobile devices to join a competition and/or make choices. For example, a user may be at a race track viewing a race and may enter a choice through a mobile device through a gaming interface presented on the mobile device. Using such a method, a user may gain an advantage if a choice is allowed to be placed during the race. For example, the user may be able to view a larger portion of the race than if the user had to move away from the race to make a choice. Such additional race information may give the mobile device user an advantage (e.g., he may know more about the race situation than other users by being able to see more of the race before making the choice). In some embodiments with a live event that includes multiple choices for the competition in a single event (e.g., choosing leaders at multiple points in a race), a player playing at a mobile device may again have an advantage by being able to observe the race without moving to a kiosk or other game play apparatus away from the event to take gaming actions.

In some embodiments, a race track and/or other gaming operator may take portion of a pool and/or other payment for providing a service. For example, in a booked gaming environment, the gaming operator may take losing wagers and/or may set odds such that it is expected to take more money than pay.

Figure 2:
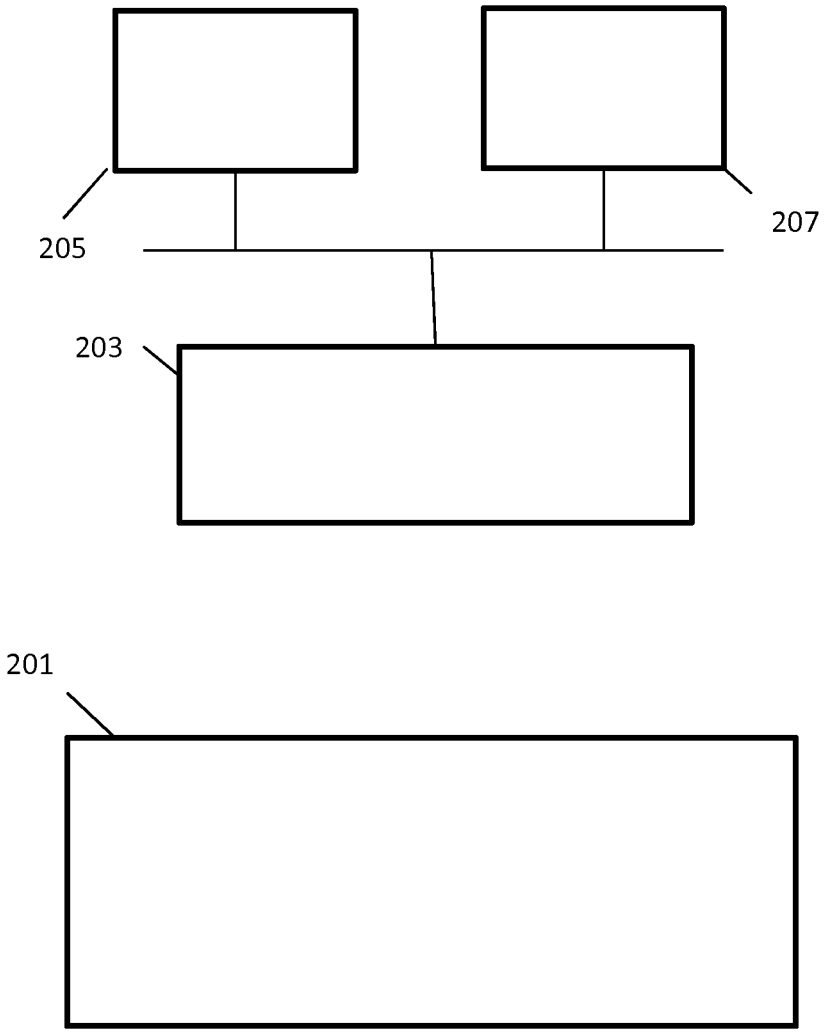
FIG. 2 shows an example of some embodiments.

FIG. 2 illustrates an example of some embodiments. For example, FIG. 2 illustrates a venue 201 at which one or more rounds of a competition may take place (e.g., a race track). FIG. 2 illustrates an example gaming system 203. Such a gaming system may be operated by a gaming operator, such as a race track operator, a multi-venue operator, a totalizer, and so on to provide functionality related to a competition. FIG. 2 illustrates a mobile device 205 through which one or more players may take actions related to a competition. FIG. 2 illustrates one or more other devices 207 through which actions related to a competition may be taken.

Venue 201 may include a horse track, a casino, a sports book, a gaming facility, a sporting venue, a stadium, and so on. It should be recognize that various embodiments are not limited to any particular venue. It should be recognized that various embodiments are not limited to a single venue, but rather may include multiple venues (e.g., related to a single gaming operator, at which events occur, that may offer a competition through a totalizer, and so on).

Gaming system 203 may include a gaming server, a totalizer, a processor, any computing device. A gaming system may include a server that is operated by a gaming provider that offers the competition. Such a gaming system may make odds determination, maintain account information, maintain auditing information, determine outcomes, take actions related to a competition (e.g., perform the method of FIG. 1), run one or more competition, accept input from players, control devices to display interfaces that allow entry of information related to one or more competition, resolve bets, choose prerecorded events, track buy-ins, and so on. It should be recognized that such a system may execute software and/or perform any actions that may facilitate a competition such as one described herein.

In some embodiments in which there may be multiple venues, a system 203 may include a system that is in some way associated with the multiple venues. For example, such a system may include a totalizer such as one operated by AmTote International. Such a totalizer or other system that may operate among a plurality of venues to allow gaming at the plurality of venues may interact with and/or include local systems at the venues (e.g., mobile device, stationary device, servers, etc.). For example, a local system may receive a buy-in or other game action and forward the buy-in or other game action to the intermediary's server (e.g., a race track server may receive the buy-in or other game action and forward it on to a totalizer). It should be recognized that any arrangement of multiple computing device in to a unified gaming system may be used as desired and that various embodiments are not limited to any particular arrangement.

Mobile device 205 may interface with gaming system 203 to facilitate gaming by one or more players. For example, mobile device 205 may display information, transmit information, and/or receive information related to a competition. Such information may be received and/or transmitted to a gaming system 203. Gaming system 203 may control a mobile device to perform a desired action (e.g., allow a player to choose a winner, show a list of possible winners, display an account balance, enable a player to buy into a competition and/or second competition, show odds determined by a gaming system to the player, display an event and/or portions thereof, and so on). Such communication may take place through a dedicated and/or public communication system (e.g., the Internet, a cell network, a Wi-Fi network at a venue).

Other device 207 may include a stationary device such as a kiosk, an off venue device (e.g., a device at an off track gaming facility, a device at a user's home, etc.), a device operated by a teller at a venue, and so on. Such a device may include a computing device that may be used to interface with a gaming system 203 in any manner (e.g., similar to and/or differently than device 205)

It should be recognized that the arrangement of FIG. 2 is given as a non-limiting example only and that various arrangement may include additional, different, alternative, more, fewer, different, no, all, and so on of such components and arrangements, and functionality, in any combination as desired.

It will be understood that the technologies described herein for making, using, or practicing various embodiments are but a subset of the possible technologies that may be used for the same or similar purposes. The particular technologies described herein are not to be construed as limiting. Rather, various embodiments contemplate alternate technologies for making, using, or practicing various embodiments.

Historic Eliminator Examples

Some embodiments may include one or more elements that may increase a speed of a competition, facilitate a decoupling from a racing or other event environment, and/or disconnect a competition from a live event. For example, some embodiments may include recorded events as a basis for a competition rather than live events. As another example, some embodiments may include a competition that relies upon portions of one or more events rather than an entirety of an event.

In one example, at least a portion of one or more recorded events may form a basis of a competition. For example, an event may be chosen from a set of possible past events to form a basis of each round of a competition. For example, a horse race from ten years ago may be chosen as a basis of a first round of a competition. Such choosing may be a random choosing, a choosing in response to a start of a competition, choosing a set of events for the competition all together, choosing an event for a round in response to a round beginning. Such events (e.g., an identity of the events) may be known or unknown to players before and/or during a competition (e.g., events may be advertised before the competition, events may not be advertised, identity of events may be obscured during a competition). Any combination of choosing methods, live and recorded events, full events and portions of events, and so on may be used together to form a basis of a competition in any arrangement.

Some embodiments may include determining an end of each event for each round of a competition. For example, an end of the event for the round may be the historical end of the event that actually occurred. In other implementations, an end may be some intermediate point of the event. For example, an end may include the first lap, the first furlong, a random point, a first half, and so on. For example, each round may include a first, middle, last, random, and so on portion of a recorded race. That portion may include a random amount of time between 1 second and 50 seconds, that portion may include a random point in the race such as when a first horse reaches a random point, and so on random or fixed end point or time.

Some embodiments may include determining a start of each event for each round of a competition. For example, a start of the event for the round may be the historical start of the event that actually occurred. In other implementations, a start may be some intermediate point of the event. For example, the start may include a final lap, a last furlong, a random point, a second half, and so on. For example, each round may include a first, middle, last, random, and so on portion of a recorded race. That portion may include a random amount of time between 1 second and 50 seconds, that portion may include a random point in the race such as when a first horse reaches a random point, and so on random or fixed start point or time.

Some embodiments may include determining a pause or choice time for each round of a competition. For example, in some embodiments, a recording of an event may be paused at some point to solicited choice making for the round and/or choices may be required to be made before some point in the event is reached. A determination may include determining when that point should be. That point may be a fixed point and/or variable point. For example, such appoint may include a time at a last minute of an event, a last lap of a race, a last furlong of a race, a last portion of an event, and so on.

In some examples, a competition using recorded or simulated events may operate similar to other embodiments described herein. Some embodiments may include live events in such a method (e.g., live events that end at random points). By using such a method, a quicker competition may be played (e.g., in ten minutes, many rounds that are 30 seconds each may be run such as by running rounds of recorded events or live events for just that long).

In another example, a competition may include more than one round in one or more events. For example, a round may include a portion of an event (e.g., random, middle, first, last, etc.). A next round may include a subsequent portion of the same event. Any number of rounds may be played in a single event. For example, an entire competition may be run in a single event. In such an example, at each of a plurality of points in a race, each player may be asked to pick a winning participant for that point. The rounds may operate similarly to those described elsewhere but in a possibly quicker rate and in a same event. Using such an embodiment, players may be more engage in a race event because they may be incentivized to pay attention to more than just an end of an event or round and may be involved in a competition that involves multiple points along a race rather than just an end of a race or event.

Figure 3:
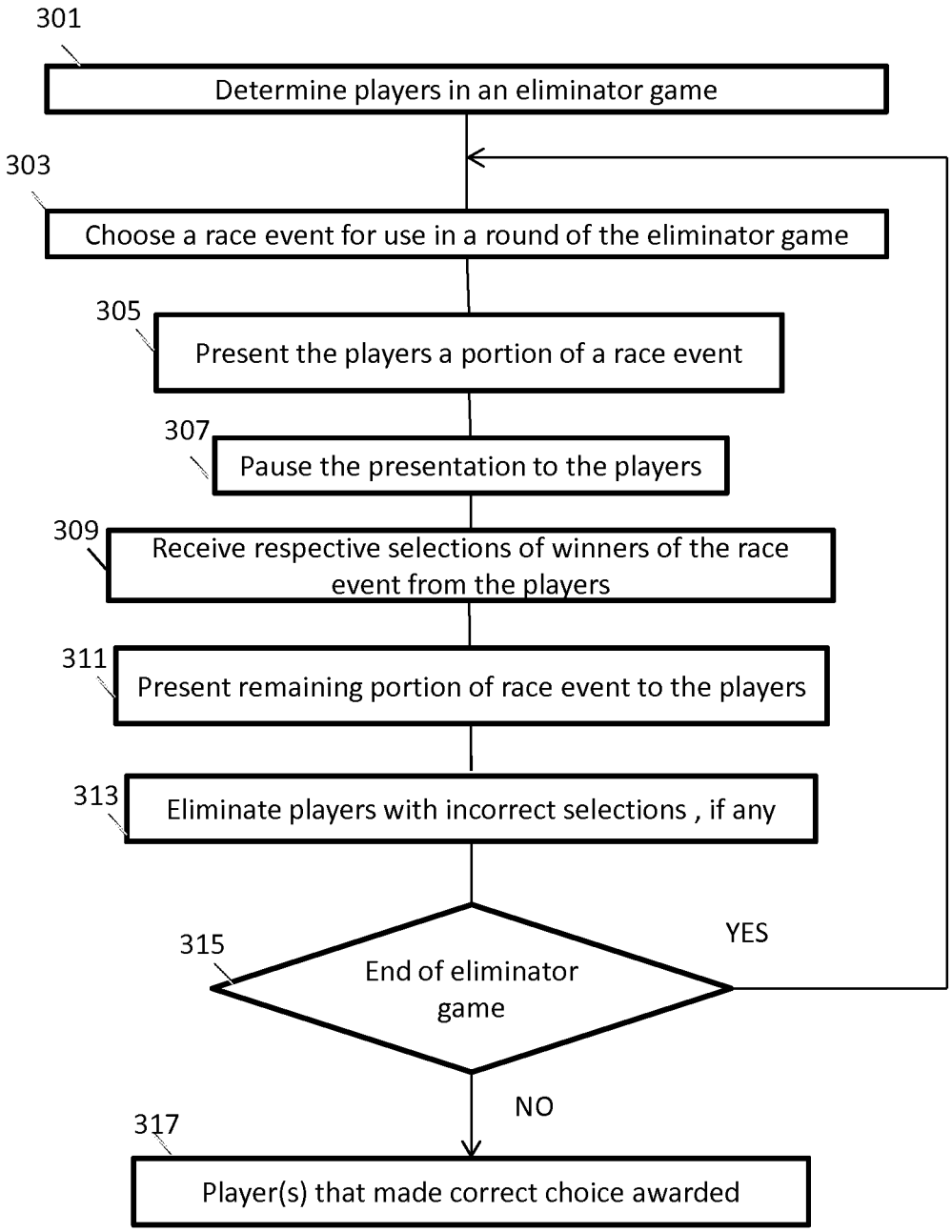
FIG. 3 shows an example method that may be performed in some embodiment.

FIG. 3 illustrates an example method that may be performed in some embodiments. The example method may for example be used in play of a historical event based game. Though examples are given in terms of historical events, it should be recognized that the example method may be used with other embodiments as desired (e.g., with live events, with simulated events, with a combination of event types, etc.). A game may be played through a mobile device, a kiosks, a slot machine like machine, a computer, a server, a client device, and/or any other device as desired. A game according to one or more embodiments described herein may be referred to as an eliminator and/or survivor game.

As indicated at block 301, some embodiments may include determining players for an eliminator game. For example, a plurality of players may risk money in and/or otherwise buy into a specific eliminator game and those players may be determined to be part of the eliminator game. Eliminator games may begin at a certain time so that players that take game actions during a period before that time may be entered into the eliminator game. A player may be placed into a next beginning eliminator game from when they take a first gaming action (E.g., pay a buy-in fee) and/or may be given a choice of an eliminator game to join when joining a game.

In some embodiments an eliminator game may have a first event. For example, players that join an eliminator game during some period before the eliminator game starts may be assigned to a same game that has a same first event. In some embodiments, an eliminator game may not have a fixed time or events. For example, different players may be playing in a same eliminator game but view different events and/or start at different times. For example a next set of people (e.g., 100 people, 10 people) may all be considered to play in a same eliminator game even if they start playing at different times. Such set of players may play the same events and/or different events). Accordingly, it should be recognized that any manner of determining which players are in an eliminator game together may be used.

As indicated at block 303, some embodiments may include determining a race event for use in a round of an eliminator game. A same race event may be used for all of the determined players in some embodiments. In some embodiments, a different race event may be used for some participants (e.g., all participants). Determining a race event may include selecting a race event from a library of race events that are stored in a race event database. A determination may be made randomly, procedurally, in order, based on desired difficulty, and so on as desired. For example, in some embodiments, race events may be tagged with a difficulty level. For each event determination, an event that is tagged with a desired difficult level may be chosen. The difficulty level may increase as the competition progresses. In a particular round, if players play based on different events, each event may be chosen for each player to have a same difficulty.

As indicated at block 305, some embodiments may include presenting a portion of a determined race event to one or more players. For example, some embodiments may include showing 10 seconds of a race event to players. The ten seconds may be at a beginning middle end, and so on of a race event. For example, ten second into a last eighth of a race may be shown in some embodiments. The same portion of the same events may be shown to each player. The same amount of a race event may be shown to each player but it may be a different event. Different portions, different amounts of times, and/or different events may be shown to different players. Presenting a portion may include reading a database of race information by a server and transmitting that information to a device for display. For example, a server may maintain race information and the information may be transmitted to a kiosk, a mobile device, and so on for display. A portion may include apportion between a determined start and a determined end, a determined start and a determined pause and/or choice point, a fixed portion that is stored in a video library, and so on.

Some embodiments may include a synchronized presentation of the portion (e.g., control by a central server to have client devices display the portion at a desired synchronized system time). In some embodiments, information about races may be stored locally for display and the central server may indicate which information to be displayed from that local information to the client server rather than transmitting the information itself. It should be recognized that any manner of presentation of desired event information regarding a portion may be used in various embodiments as desired.

Some embodiments may include presenting handicapping information about race participants to one or more players. For example, along with storing racing data, a gaming server may maintain historical handicapping data (e.g., pari-mutuel pools for the actual event, predictions by professionals that were made for the actual event, information about the race participants that can be used to educate bettors, etc.). Such handicapping information may be presented to one or more players to aid them in making a bet with regard to one or more eliminator rounds (e.g., by showing that information through a device along with a gaming interface and/or first portion of a race event).

As indicated at block 307, some embodiments may include pausing a presentation and/or otherwise ending the presentation of the portion. For example, after the portion has been presented, a selection may be solicited from the players. For example, a video of a race portion may be paused and a betting interface may enable a selection of a winner for the race after the portion has been displayed. Each (non-eliminated/remaining) player may be asked to make such a selection. The selection may be required to be made in a time period (e.g., 10 seconds, before the presentation is resumed, etc.). If no selection is made, in some embodiments, a player may forfeit their entry which may cause them to be eliminated. In some embodiments, after that time period and/or after all players have made a selection, the game may continue. In some embodiments, the presentation may not be paused, but rather, the selection interface may allow selection during presentation up to some point of the event. A display of a time or distance remaining for selection may be shown.

As indicated at block 309, some embodiments may include receiving a respective selection of a winner from each of the players remaining in the eliminator game. Such a selection may be made through a gaming interface of a device. Such a selection may identify which race participant a player has selected to win the event based on the portion of the event shown to the player. A correct choice may earn the player a win in the round of the eliminator game. An incorrect choice may result in a loss for the round for the player and possibly elimination from the eliminator game.

As indicated at block 311, some embodiments may include presenting a remaining portion of an event (and/or multiple events depending on the embodiment) to the players. For example, an event from the point where an event was paused or otherwise when betting is required to some point that is considered the end of a choice period may be presenting to the players. The portion may be the rest of the race until the end of the race and/or until some other determined and/or fixed end point. At the point where the presentation ends may be the point where the race winners may be evaluated against player selections. The end point may be some intermediate point in some embodiments. Presenting such information may include presenting similar to the presentation of the earlier portion of the race. The presenting information may be for a same or different events for the players based on the desire of the gaming operator (e.g., different final portions of different events may be presented in embodiments where players are playing related to different events). The presentation may be synchronized or may take place at different times depending on the desires of a gaming operator.

As indicated at block 313, some embodiments may include eliminating players that have made incorrect selections. For example, any player that did not correctly select a winning participant in the race just shown may be eliminated. Other players may move onto a next round, win a game, and so on. The special situation where all players are eliminated is discussed elsewhere. Eliminating may include removing the player from the game (e.g., ending the game for the player, the player losing the game, etc.).

As indicated at block 315, some embodiments may include determining if an eliminator game has ended. A game may end if no players remain, one player remains, and/or some other ending trigger is reached (e.g., some other number of players remain, some number of rounds have passed such as 10, etc.). If the game has not ended, the game may loop back to block 303 for one or more subsequent elimination rounds that may involve the as yet uneliminated players from the completed round.

As indicated at block 317, if the game is determined to be at an end, one or more players that remain in the game may be awarded in some embodiments. For example, such one or more players may be given money from a pool of buy in money that the players in the game paid to join the game. Some embodiments may include a house giving some award, a jackpot amount, and so on.

In some embodiments, rounds and selections by players may take place simultaneously and/or substantially simultaneously (e.g., transmission, processing, synchronization errors ignored). In some embodiments, presentation and selection may occur near a sometime and/or at different times as desired. In some embodiments, one or more methods of obscuring videos and/or preventing collusion from one player to another player if timing is not similar or the same may be used.

It should be recognized that various embodiments may include different, none, similar, more, fewer, differently ordered, and so on actions as desired. For example, some embodiments may not show a first portion before selection is requested. Various embodiments may be employed together in any combination. A game according to some embodiments may allow players to play quick eliminator games using historic game data rather than waiting for new races to be run to play and/or may play in a fashion that allows numerous players in various locations to participate.

Choosing Events Examples

Some embodiments may include maintaining a library of races (and/or other events). For example, video footage from race courses may be transmitted to and/or received by a server. The information may be stored in a database and tagged in any manner for future retrieval.

Some embodiments may include categorizing race data for future use. For example, some embodiments may include tagging race data based on a difficulty assessment so that it can be accessed when a race of a particular difficulty is desired in the future. For example, three levels of difficulty may be maintained in some embodiments. Each level of difficulty may correspond with how close race participants are at a point in the race when a selection would be solicited. Each race may have multiple difficulties based on different points along the race. The closer the participants are together at that point, the more difficult selection of the winner may be. For example, if a horse is far ahead at a selection point then that race may be an easy race because the information at that point provides a lot of information to the players. If the horses are all even at the selection point that race may be a hard race because the selection point information may provide little information to ease the selection. Other methods of difficulty rating may be used (e.g., if the selection point gives misleading information that may raise the difficulty).

Some embodiments may select a difficulty for an eliminator round. For example, the difficulty may be selected randomly, the difficulty may be selected to increase round by round, the difficulty may be selected according to some desired order, and/or in any manner desired In some embodiments a race with that difficulty may be selected at random from a library of from races that are tagged with that difficulty. In some embodiments, higher quality videos may be preferred to lower quality videos if they are available for selection.

It should be recognized that maintaining, obtaining, cataloging, and/or selecting events may be performed in any manner desired and that the examples here are non-limiting only.

Although some embodiments may include actual historical races, other embodiments may include lie races and/or virtual races. For example, in some embodiments a difficulty may be determined and a virtual race may be create to simulate a race with that difficulty level.

Obscuring Examples

Presenting a part of a race before a selection by a player may enable cheating to occur. For example, a computer algorithm may be used to analyze the portion of the race and determine which actual race that portion is from. A similar process may be performed using the smart phone application known as Shazam for analyzing portions of music. With the knowledge of which race a presented portion is from, a user may then know who won the race and cheat at the selection point.

Accordingly, some embodiments may include obscuring and/or selecting portions and/or races to minimize such cheating. One method of obscuring may include removing original sound from the race (e.g., replacing with new game sound or no sound) so that sound may not be used as an input for cheating. One method of obscuring may include adjusting a presentation to include a different color or additional/removed information that was not originally present (e.g., video manipulation to replace orange with yellow, remove information from an area of a screen, resize a screen, show only certain portions of a recording). One method of obscuring may include adjusting the quality of a video (e.g., reducing quality form an original, reducing resolution, reducing frames, etc.). One method may include preferring new races and/or not reusing races for a period of time. One method of obscuring may include choosing a random selection point rather than a fixed selection point so that analysis time for finding the race may be unknown. One method of obscuring may include ending a race at a random or otherwise non fixed time (e.g., at a last eight of race rather than the actual end of a race). It should be recognized that these are examples only and not limiting in any manner.

Single Race Eliminator Examples

As discussed above, an eliminator game may take place over the course of a single event (live or historic). For example, various portions of a race may be a round of an eliminator game. The portions may be continuous (one portion ends the next immediately begins, such as consecutive eights of a race), and/or non-continuous (e.g., one eight then a break eighth where the use can select for a next eighth, etc.). A selection period may end one eighth of a race before the judgment point for the selection (e.g., when a first participant reaches the start of the eighth). It should be recognized that eighths are given as examples only and that any desired portion may be used, such as laps in a nascar race, etc.

Track Events Examples

A computing device (e.g., server) may receive information about events, receive selections of winners by players, determine winners for a round and/or competition, etc.

Information about an event may be received from any source so that the device may determine which players made a correct selection and/or which players made an incorrect selection.

Information may be received from a person spotting events (e.g., a person pressing a button into a computing interface). For example, an employee of a gaming operator may enter the ordering of race participants at an end of a race, may enter when a race begins, may enter when a participant reaches a point in a race, may enter which participants finishes a portion of a race first, and so on.

Information may be received from a computing device of some sort. For example, a GPS may be installed on each participant and the GPS data may be used to determine locations and events (e.g., where each participant is on a track, when they reach various points, and so on). Information may be determined based on video monitoring and/or analysis of a race. Various electronic means of determining race participants' locations may be used. One example system is the Trakus system.

Free for all Example

Some embodiments may include an optional free for all play. For example, during play of an eliminator game (e.g., for any round of the game) one or more players may place a bet on that particular round. The player may be a player of the eliminator game (e.g., previously eliminated, not eliminated) or some other player not involved with the eliminator round. A player may then play in the single round of the eliminator game similarly to other players in that round. A difference between play in this mode and in the eliminator game mode may be that the free for all mode may be a single round mode. Winners of the free for all mode may split a pool of winnings from other players in that free for all mode but may not impact the eliminator game. Accordingly, through play of a single round, multiple games and/or pools may be played based on a single event. In some embodiments, different wagers may be made on the free for all mode and each wager denomination may be pooled together in its own pool with other wagers of the same denomination (e.g., a 5 dollar pool, a 20 dollar pool, etc. for the same free for all round).

Choose N Eliminator Examples

Figure 4:
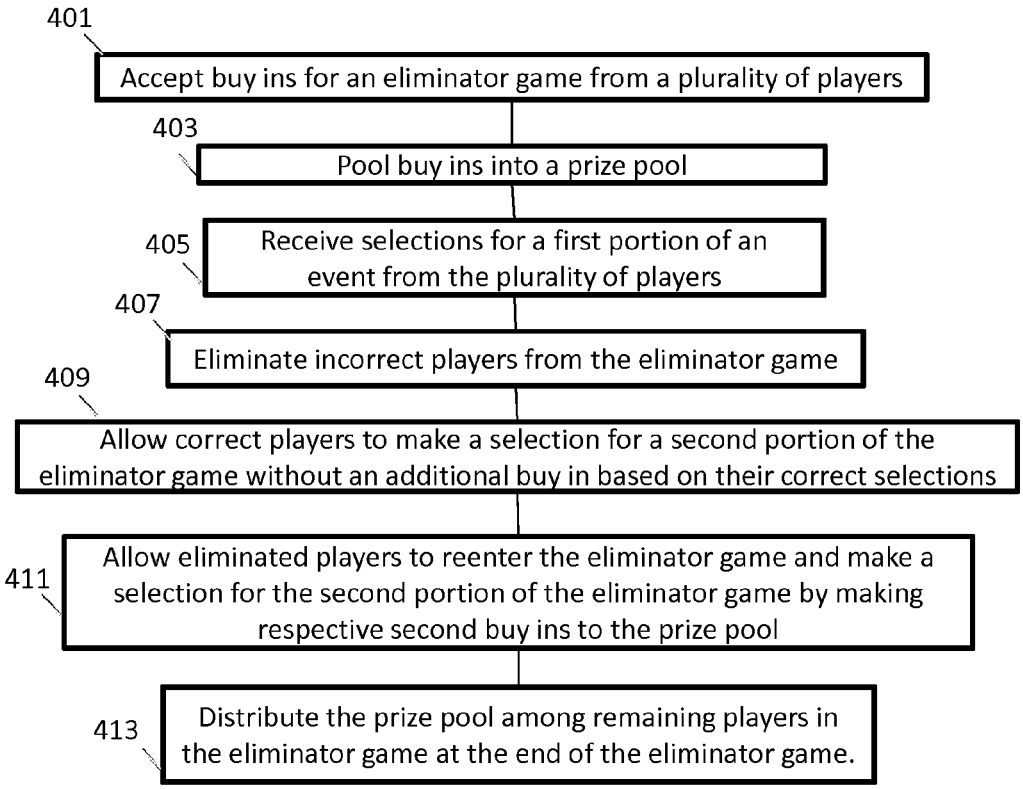
FIG. 4 shows an example method that may be performed in some embodiment.

FIG. 4 illustrates an example method that may be used in some embodiments. Such a method may allow an eliminator game with the ability to reenter the game after elimination. Such a game may be especially useful for longer events such as a Nascar race where early eliminated players may want the option to rejoin the game later in the game. Such a method may be performed by a gaming server, a computing device, a client device, and so on.

As illustrated at block 401, some embodiments may include accepting buy ins for an eliminator game from a plurality of players. Players may buy in at a start of a race. Some embodiments may require that players who will participate in the game must buy in at the start of the race. Some embodiments my allow players to buy in during the race (e.g., after some number of race selections in the eliminator game have passed already, before some maximum number of race selections have passed). Buy-in may include risking an amount of money for the chance to win the game (e.g., with cash, from a gaming account, etc.). For example, at the beginning of a car race, players may use their mobile devices to place a wager on the competition that is based on the race from a gaming account and/or credit card.

As indicated at block 403, some embodiments may include pooling buy ins received into a prize pool for the eliminator game. Such a pool may include a pari-mutuel pool maintained by a gaming operator. A gaming operator may take out some portion of the pool as a compensation for running the event. The prize pool maybe paid to one or more winners of the eliminator game.

As indicated at block 405, some embodiments may include receiving respective selections for a first portion of an event from the plurality of players. For example, before a car race starts, players may choose who they thing will be leading after a first lap, set of laps, portion, of a lap, etc. The first portion may be any portion of the race and may not be limited to the beginning portion of the race (e.g., may be a later lap). Selection may be required from all players and/or not required for a specific portion depending on the desired implementation. Selection may be made through a mobile device of a player who may be watching the race. The portion may be the same or different for each player (e.g., all players may be required to make a selection on a specific portion, players may pick which portions they desire to make a selection for from a set of possible portions). For example, a player may be required to make at least one selection in every five laps but not every lap and/or may be required to make a selection in every lap.

As indicated at block 407, some embodiments may include eliminating players that made incorrect selections for the first portion from the eliminator game. For example, if the player selected a wrong car to be in the lead at the end of the first lap, that player may be eliminated from the game. Some embodiments may allow some number of incorrect selections before elimination.

As indicated at block 409, some embodiments may include allowing correct players to make a selection for a second portion of the eliminator game without an additional buy in. For example, because a player made a correct selection they may be allowed to move onto a next round of the game for free. The second portion may be a next portion and each correct player may be required to make such a selection in some embodiments. In other embodiments, player may be able to select their own next portion by skipping some portions where selection is available (e.g., required to make a selection every five laps, required to make at least some number of selections through the race, etc.).

As indicated at block 411, some embodiments may include allowing eliminated players to reenter the eliminator game and make a selection for a second portion of the eliminator game by making a buy in to the prize pool. For example, a player may use a mobile device interface to place money into the prize pool from a gaming account and/or credit card to buy back into the eliminator game after being eliminated. In some implementations, a player may be required to buy back in for a next portion of game after their elimination or forfeit possible future buy ins. In some implementations, a player may be able to buy back in at a future portion when they desire. In some implementations, a player may be prevented from buying back into an eliminator game at some point in the game. For example, a final X (e.g., 10, 5) portions (e.g., laps) may not be available for buy backs. This may provide sufficient final portions for an eliminator game to eliminate players. Otherwise, a players may buy back in on the last lap and win the game without participating sufficiently. Some embodiments may include determining that a final set of portions has been reached and prevent buy-ins after that final set has been reached.

A device may receive such selections and continue to evaluate them, eliminate players, and so on until an ending of an eliminator game. Any number of eliminator rounds may be run or required in various embodiments according to the rules of a gaming operator. For example, an eliminator game may continue from a beginning of the race until the end of a race or until only one player remains in the eliminator game. Throughout the game, eliminated players may buy back into the eliminator game (e.g., any number of times, a limited number of times, according to any operator restrictions, until a final set of portions, etc.).

As indicated at block 413, some embodiments may include distributing the prize pool among remaining players in the eliminator game at the end of the eliminator game. The pool may include original buy ins and all subsequent re-buy ins from eliminated player.

A winner may be determined according to various methods. For example, a method as described above where a final player or players at a final round are considered winners may be used in some embodiments. In some embodiments, a number of correct selections by the players may be used to determine a winner (e.g., the winner may be the player with the most number of correct selections during the game that also remains at the end of the game, a player that had the most number of correct selection even if that player does not remain at the end, etc.). Such an embodiment may encourage players to make selections often and continue to buy back in to make more selections. Some embodiments may chose winners so that the winner made at least some minimum number of correct selections. Such an embodiment may allow players to qualify for a final part of the game by making the minimum correct selections. Some such embodiments may require selections at an end portion of the game (e.g., the last X, 10 portions during which buy back is not allowed) but may not require selections during all other portions (e.g., as long as the minimum is reached). Some embodiments may include bonusing to players based on the number of correct choices (e.g., for each correct choice gain a greater percentage of the prize pool at the end, get some amount of money for each correct choice, etc.).

Some embodiments may include a counter of correct vs incorrect choices. For example, a player may stay in a game as long as the correct choices outnumbers the incorrect choices in some manner (e.g., at least greater, greater than some threshold, etc.). Accordingly, players may not be eliminated for all incorrect choices in some implementations.

It should be recognized that various embodiments and the illustration of FIG. 4 are given as examples only.

It should be recognized that various examples herein are given as non-limiting examples only. For example, races are described, but it should be recognized that some embodiment may not be so limited. Rather, any event may be used. For example, players may be asked to choose winners of on going football games, a single football game at various points, any event, any series of events, fantasy games, real games, and so on.

Modifications, additions, or omissions may be made to the method without departing from the scope of the invention. The method may include more, fewer, or other steps. Additionally, steps may be performed in any suitable order without departing from the scope of the invention.

While this disclosure has been described in terms of certain embodiments and generally associated methods, alterations and permutations of the embodiments and methods will be apparent to those skilled in the art. Accordingly, the above description of example embodiments does not constrain this disclosure. Other changes, substitutions, and alterations are also possible without departing from the spirit and scope of this disclosure, as defined by the claims herein.

The following sections provide a guide to interpreting the present application.

II. Terms

The term "product" means any machine, manufacture and/or composition of matter, unless expressly specified otherwise.

The term "process" means any process, algorithm, method or the like, unless expressly specified otherwise.

Each process (whether called a method, algorithm or otherwise) inherently includes one or more steps, and therefore all references to a "step" or "steps" of a process have an inherent antecedent basis in the mere recitation of the term 'process' or a like term. Accordingly, any reference in a claim to a 'step' or 'steps' of a process has sufficient antecedent basis.

The term "invention" and the like mean "the one or more inventions disclosed in this application", unless expressly specified otherwise.

The terms "an embodiment", "embodiment", "embodiments", "the embodiment", "the embodiments", "one or more embodiments", "some embodiments", "certain embodiments", "one embodiment", "another embodiment" and the like mean "one or more (but not all) embodiments of the disclosed invention(s)", unless expressly specified otherwise.

The term "variation" of an invention means an embodiment of the invention, unless expressly specified otherwise.

A reference to "another embodiment" in describing an embodiment does not imply that the referenced embodiment is mutually exclusive with another embodiment (e.g., an embodiment described before the referenced embodiment), unless expressly specified otherwise.

The terms "including", "comprising" and variations thereof mean "including but not necessarily limited to", unless expressly specified otherwise. Thus, for example, the sentence "the portfolio includes a red widget and a blue widget" means the portfolio includes the red widget and the blue widget, but may include something else.

The term "consisting of" and variations thereof means "including and limited to", unless expressly specified otherwise. Thus, for example, the sentence "the portfolio consists of a red widget and a blue widget" means the portfolio includes the red widget and the blue widget, but does not include anything else.

The term "compose" and variations thereof means "to make up the constituent parts of, component of or member of", unless expressly specified otherwise. Thus, for example, the sentence "the red widget and the blue widget compose a portfolio" means the portfolio includes the red widget and the blue widget.

The term "exclusively compose" and variations thereof means "to make up exclusively the constituent parts of, to be the only components of or to be the only members of", unless expressly specified otherwise. Thus, for example, the sentence "the red widget and the blue widget exclusively compose a portfolio" means the portfolio consists of the red widget and the blue widget, and nothing else.

The terms "a", "an" and "the" mean "one or more", unless expressly specified otherwise.

The term "plurality" means "two or more", unless expressly specified otherwise.

The term "herein" means "in the present application, including anything which may be incorporated by reference", unless expressly specified otherwise.

The phrase "at least one of", when such phrase modifies a plurality of things (such as an enumerated list of things) means any combination of one or more of those things, unless expressly specified otherwise. For example, the phrase "at least one of a widget, a car and a wheel" means either (i) a widget, (ii) a car, (iii) a wheel, (iv) a widget and a car, (v) a widget and a wheel, (vi) a car and a wheel, or (vii) a widget, a car and a wheel. The phrase "at least one of", when such phrase modifies a plurality of things does not mean "one of" each of the plurality of things.

Numerical terms such as "one", "two", etc. when used as cardinal numbers to indicate quantity of something (e.g., one widget, two widgets), mean the quantity indicated by that numerical term, but do not mean at least the quantity indicated by that numerical term. For example, the phrase "one widget" does not mean "at least one widget", and therefore the phrase "one widget" does not cover, e.g., two widgets.

The phrase "based on" does not mean "based only on", unless expressly specified otherwise. In other words, the phrase "based on" describes both "based only on" and "based at least on". The phrase "based at least on" is equivalent to the phrase "based at least in part on".

The term "represent" and like terms are not exclusive, unless expressly specified otherwise. For example, the term "represents" does not mean "represents only", unless expressly specified otherwise. In other words, the phrase "the data represents a credit card number" describes both "the data represents only a credit card number" and "the data represents a credit card number and the data also represents something else".

The term "whereby" is used herein only to precede a clause or other set of words that express only the intended result, objective or consequence of something that is previously and explicitly recited. Thus, when the term "whereby" is used in a claim, the clause or other words that the term "whereby" modifies do not establish specific further limitations of the claim or otherwise restricts the meaning or scope of the claim.

The term "e.g." and like terms mean "for example", and thus does not limit the term or phrase it explains. For example, in the sentence "the computer sends data (e.g., instructions, a data structure) over the Internet", the term "e.g." explains that "instructions" are an example of "data" that the computer may send over the Internet, and also explains that "a data structure" is an example of "data" that the computer may send over the Internet. However, both "instructions" and "a data structure" are merely examples of "data", and other things besides "instructions" and "a data structure" can be "data".

The term "respective" and like terms mean "taken individually". Thus if two or more things have "respective" characteristics, then each such thing has its own characteristic, and these characteristics can be different from each other but need not be. For example, the phrase "each of two machines has a respective function" means that the first such machine has a function and the second such machine has a function as well. The function of the first machine may or may not be the same as the function of the second machine.

The term "i.e." and like terms mean "that is", and thus limits the term or phrase it explains. For example, in the sentence "the computer sends data (i.e., instructions) over the Internet", the term "i.e." explains that "instructions" are the "data" that the computer sends over the Internet.

Any given numerical range shall include whole and fractions of numbers within the range. For example, the range "1 to 10" shall be interpreted to specifically include whole numbers between 1 and 10 (e.g., 1, 2, 3, 4, . . . 9) and non-whole numbers (e.g., 1.1, 1.2, . . . 1.9).

Where two or more terms or phrases are synonymous (e.g., because of an explicit statement that the terms or phrases are synonymous), instances of one such term/phrase does not mean instances of another such term/phrase must have a different meaning. For example, where a statement renders the meaning of "including" to be synonymous with "including but not limited to", the mere usage of the phrase "including but not limited to" does not mean that the term "including" means something other than "including but not limited to".

III. Determining

The term "determining" and grammatical variants thereof (e.g., to determine a price, determining a value, determine an object which meets a certain criterion) is used in an extremely broad sense. The term "determining" encompasses a wide variety of actions and therefore "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing, and the like.

The term "determining" does not imply certainty or absolute precision, and therefore "determining" can include estimating, extrapolating, predicting, guessing and the like.

The term "determining" does not imply that mathematical processing must be performed, and does not imply that numerical methods must be used, and does not imply that an algorithm or process is used.

The term "determining" does not imply that any particular device must be used. For example, a computer need not necessarily perform the determining.

IV. Forms of Sentences

Where a limitation of a first claim would cover one of a feature as well as more than one of a feature (e.g., a limitation such as "at least one widget" covers one widget as well as more than one widget), and where in a second claim that depends on the first claim, the second claim uses a definite article "the" to refer to the limitation (e.g., "the widget"), this does not imply that the first claim covers only one of the feature, and this does not imply that the second claim covers only one of the feature (e.g., "the widget" can cover both one widget and more than one widget).

When an ordinal number (such as "first", "second", "third" and so on) is used as an adjective before a term, that ordinal number is used (unless expressly specified otherwise) merely to indicate a particular feature, such as to distinguish that particular feature from another feature that is described by the same term or by a similar term. For example, a "first widget" may be so named merely to distinguish it from, e.g., a "second widget". Thus, the mere usage of the ordinal numbers "first" and "second" before the term "widget" does not indicate any other relationship between the two widgets, and likewise does not indicate any other characteristics of either or both widgets. For example, the mere usage of the ordinal numbers "first" and "second" before the term "widget" (1) does not indicate that either widget comes before or after any other in order or location; (2) does not indicate that either widget occurs or acts before or after any other in time; and (3) does not indicate that either widget ranks above or below any other, as in importance or quality. In addition, the mere usage of ordinal numbers does not define a numerical limit to the features identified with the ordinal numbers. For example, the mere usage of the ordinal numbers "first" and "second" before the term "widget" does not indicate that there must be no more than two widgets.

When a single device, article or other product is described herein, more than one device/article (whether or not they cooperate) may alternatively be used in place of the single device/article that is described. Accordingly, the functionality that is described as being possessed by a device may alternatively be possessed by more than one device/article (whether or not they cooperate).

Similarly, where more than one device, article or other product is described herein (whether or not they cooperate), a single device/article may alternatively be used in place of the more than one device or article that is described. For example, a plurality of computer-based devices may be substituted with a single computer-based device. Accordingly, the various functionality that is described as being possessed by more than one device or article may alternatively be possessed by a single device/article.

The functionality and/or the features of a single device that is described may be alternatively embodied by one or more other devices which are described but are not explicitly described as having such functionality/features. Thus, other embodiments need not include the described device itself, but rather can include the one or more other devices which would, in those other embodiments, have such functionality/features.

V. Disclosed Examples and Terminology are not Limiting

Neither the Title (set forth at the beginning of the first page of the present application) nor the Abstract (set forth at the end of the present application) is to be taken as limiting in any way as the scope of the disclosed invention(s), is to be used in interpreting the meaning of any claim or is to be used in limiting the scope of any claim. An Abstract has been included in this application merely because an Abstract is required under 37 C.F.R. §1.72(b).

The title of the present application and headings of sections provided in the present application are for convenience only, and are not to be taken as limiting the disclosure in any way.

Numerous embodiments are described in the present application, and are presented for illustrative purposes only. The described embodiments are not, and are not intended to be, limiting in any sense. The presently disclosed invention(s) are widely applicable to numerous embodiments, as is readily apparent from the disclosure. One of ordinary skill in the art will recognize that the disclosed invention(s) may be practiced with various modifications and alterations, such as structural, logical, software, and electrical modifications. Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

Though an embodiment may be disclosed as including several features, other embodiments of the invention may include fewer than all such features. Thus, for example, a claim may be directed to less than the entire set of features in a disclosed embodiment, and such claim would not include features beyond those features that the claim expressly recites.

No embodiment of method steps or product elements described in the present application constitutes the invention claimed herein, or is essential to the invention claimed herein, or is coextensive with the invention claimed herein, except where it is either expressly stated to be so in this specification or expressly recited in a claim.

The preambles of the claims that follow recite purposes, benefits and possible uses of the claimed invention only and do not limit the claimed invention.

The present disclosure is not a literal description of all embodiments of the invention(s). Also, the present disclosure is not a listing of features of the invention(s) which must be present in all embodiments.

All disclosed embodiment are not necessarily covered by the claims (even including all pending, amended, issued and canceled claims). In addition, an embodiment may be (but need not necessarily be) covered by several claims. Accordingly, where a claim (regardless of whether pending, amended, issued or canceled) is directed to a particular embodiment, such is not evidence that the scope of other claims do not also cover that embodiment.

Devices that are described as in communication with each other need not be in continuous communication with each other, unless expressly specified otherwise. On the contrary, such devices need only transmit to each other as necessary or desirable, and may actually refrain from exchanging data most of the time. For example, a machine in communication with another machine via the Internet may not transmit data to the other machine for long period of time (e.g. weeks at a time). In addition, devices that are in communication with each other may communicate directly or indirectly through one or more intermediaries.

A description of an embodiment with several components or features does not imply that all or even any of such components/features are required. On the contrary, a variety of optional components are described to illustrate the wide variety of possible embodiments of the present invention(s). Unless otherwise specified explicitly, no component/feature is essential or required.

Although process steps, algorithms or the like may be described or claimed in a particular sequential order, such processes may be configured to work in different orders. In other words, any sequence or order of steps that may be explicitly described or claimed does not necessarily indicate a requirement that the steps be performed in that order. The steps of processes described herein may be performed in any order possible. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to the invention(s), and does not imply that the illustrated process is preferred.

Although a process may be described as including a plurality of steps, that does not imply that all or any of the steps are preferred, essential or required. Various other embodiments within the scope of the described invention(s)

include other processes that omit some or all of the described steps. Unless otherwise specified explicitly, no step is essential or required.

Although a process may be described singly or without reference to other products or methods, in an embodiment the process may interact with other products or methods. For example, such interaction may include linking one business model to another business model. Such interaction may be provided to enhance the flexibility or desirability of the process.

Although a product may be described as including a plurality of components, aspects, qualities, characteristics and/or features, that does not indicate that any or all of the plurality are preferred, essential or required. Various other embodiments within the scope of the described invention(s) include other products that omit some or all of the described plurality.

An enumerated list of items (which may or may not be numbered) does not imply that any or all of the items are mutually exclusive, unless expressly specified otherwise. Likewise, an enumerated list of items (which may or may not be numbered) does not imply that any or all of the items are comprehensive of any category, unless expressly specified otherwise. For example, the enumerated list "a computer, a laptop, a PDA" does not imply that any or all of the three items of that list are mutually exclusive and does not imply that any or all of the three items of that list are comprehensive of any category.

An enumerated list of items (which may or may not be numbered) does not imply that any or all of the items are equivalent to each other or readily substituted for each other.

All embodiments are illustrative, and do not imply that the invention or any embodiments were made or performed, as the case may be.

VI. Computing

It will be readily apparent to one of ordinary skill in the art that the various processes described herein may be implemented by, e.g., appropriately programmed general purpose computers, special purpose computers and computing devices. Typically a processor (e.g., one or more microprocessors, one or more microcontrollers, one or more digital signal processors) will receive instructions (e.g., from a memory or like device), and execute those instructions, thereby performing one or more processes defined by those instructions. Instructions may be embodied in, e.g., one or more computer programs, one or more scripts.

A "processor" means one or more microprocessors, central processing units (CPUs), computing devices, microcontrollers, digital signal processors, or like devices or any combination thereof, regardless of the architecture (e.g., chip-level multiprocessing/multi-core, RISC, CISC, Microprocessor without Interlocked Pipeline Stages, pipelining configuration, simultaneous multithreading).

Thus a description of a process is likewise a description of an apparatus for performing the process. The apparatus that performs the process can include, e.g., a processor and those input devices and output devices that are appropriate to perform the process.

Further, programs that implement such methods (as well as other types of data) may be stored and transmitted using a variety of media (e.g., computer readable media) in a number of manners. In some embodiments, hard-wired circuitry or custom hardware may be used in place of, or in combination with, some or all of the software instructions that can implement the processes of various embodiments. Thus, various combinations of hardware and software may be used instead of software only.

The term "computer-readable medium" refers to any medium, a plurality of the same, or a combination of different media, that participate in providing data (e.g., instructions, data structures) which may be read by a computer, a processor or a like device. Such a medium may take many forms, including but not limited to, non-volatile media, volatile media, and transmission media. Non-volatile media include, for example, optical or magnetic disks and other persistent memory. Volatile media include dynamic random access memory (DRAM), which typically constitutes the main memory. Transmission media include coaxial cables, copper wire and fiber optics, including the wires that comprise a system bus coupled to the processor. Transmission media may include or convey acoustic waves, light waves and electromagnetic emissions, such as those generated during radio frequency (RF) and infrared (IR) data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, a carrier wave as described hereinafter, or any other medium from which a computer can read.

Various forms of computer readable media may be involved in carrying data (e.g. sequences of instructions) to a processor. For example, data may be (i) delivered from RAM to a processor; (ii) carried over a wireless transmission medium; (iii) formatted and/or transmitted according to numerous formats, standards or protocols, such as Ethernet (or IEEE 802.3), SAP, ATP, Bluetooth, and TCP/IP, TDMA, CDMA, and 3G; and/or (iv) encrypted to ensure privacy or prevent fraud in any of a variety of ways well known in the art.

Thus a description of a process is likewise a description of a computer-readable medium storing a program for performing the process. The computer-readable medium can store (in any appropriate format) those program elements which are appropriate to perform the method.

Just as the description of various steps in a process does not indicate that all the described steps are required, embodiments of an apparatus include a computer/computing device operable to perform some (but not necessarily all) of the described process.

Likewise, just as the description of various steps in a process does not indicate that all the described steps are required, embodiments of a computer-readable medium storing a program or data structure include a computer-readable medium storing a program that, when executed, can cause a processor to perform some (but not necessarily all) of the described process.

Where databases are described, it will be understood by one of ordinary skill in the art that (i) alternative database structures to those described may be readily employed, and (ii) other memory structures besides databases may be readily employed. Any illustrations or descriptions of any sample databases presented herein are illustrative arrangements for stored representations of information. Any number of other arrangements may be employed besides those suggested by, e.g., tables illustrated in drawings or elsewhere. Similarly, any illustrated entries of the databases represent exemplary information only; one of ordinary skill in the art will understand that the number and content of the entries can be different from those described herein. Further, despite any depiction of the databases as tables, other formats (including relational databases, object-based models and/or distributed databases) could be used to store and manipulate the data types described herein. Likewise, object methods or behaviors of a database can be used to implement various processes, such as the described herein. In addition, the databases may, in a known manner, be stored locally or remotely from a device which accesses data in such a database.

Various embodiments can be configured to work in a network environment including a computer that is in communication (e.g., via a communications network) with one or more devices. The computer may communicate with the devices directly or indirectly, via any wired or wireless medium (e.g. the Internet, LAN, WAN or Ethernet, Token Ring, a telephone line, a cable line, a radio channel, an optical communications line, commercial on-line service providers, bulletin board systems, a satellite communications link, a combination of any of the above). Each of the devices may themselves comprise computers or other computing devices, such as those based on the Intel® Pentium® or Centrino™ processor, that are adapted to communicate with the computer. Any number and type of devices may be in communication with the computer.

In an embodiment, a server computer or centralized authority may not be necessary or desirable. For example, the present invention may, in an embodiment, be practiced on one or more devices without a central authority. In such an embodiment, any functions described herein as performed by the server computer or data described as stored on the server computer may instead be performed by or stored on one or more such devices.

Where a process is described, in an embodiment the process may operate without any user intervention. In another embodiment, the process includes some human intervention (e.g., a step is performed by or with the assistance of a human).

VII. Continuing Applications

The present disclosure provides, to one of ordinary skill in the art, an enabling description of several embodiments and/or inventions. Some of these embodiments and/or inventions may not be claimed in the present application, but may nevertheless be claimed in one or more continuing applications that claim the benefit of priority of the present application.

Applicants intend to file additional applications to pursue patents for subject matter that has been disclosed and enabled but not claimed in the present application.

VIII. 35 U.S.C. §112, Paragraph 6

In a claim, a limitation of the claim which includes the phrase "means for" or the phrase "step for" means that 35 U.S.C. §112, paragraph 6, applies to that limitation.

In a claim, a limitation of the claim which does not include the phrase "means for" or the phrase "step for" means that 35 U.S.C. §112, paragraph 6 does not apply to that limitation, regardless of whether that limitation recites a function without recitation of structure, material or acts for performing that function. For example, in a claim, the mere use of the phrase "step of" or the phrase "steps of" in referring to one or more steps of the claim or of another claim does not mean that 35 U.S.C. §112, paragraph 6, applies to that step(s).

With respect to a means or a step for performing a specified function in accordance with 35 U.S.C. §112, paragraph 6, the corresponding structure, material or acts described in the specification, and equivalents thereof, may perform additional functions as well as the specified function.

Computers, processors, computing devices and like products are structures that can perform a wide variety of functions. Such products can be operable to perform a specified function by executing one or more programs, such as a program stored in a memory device of that product or in a memory device which that product accesses. Unless expressly specified otherwise, such a program need not be based on any particular algorithm, such as any particular algorithm that might be disclosed in the present application. It is well known to one of ordinary skill in the art that a specified function may be implemented via different algorithms, and any of a number of different algorithms would be a mere design choice for carrying out the specified function.

Therefore, with respect to a means or a step for performing a specified function in accordance with 35 U.S.C. §112, paragraph 6, structure corresponding to a specified function includes any product programmed to perform the specified function. Such structure includes programmed products which perform the function, regardless of whether such product is programmed with (i) a disclosed algorithm for performing the function, (ii) an algorithm that is similar to a disclosed algorithm, or (iii) a different algorithm for performing the function.

Where there is recited a means for performing a function that is a method, one structure for performing this method includes a computing device (e.g., a general purpose computer) that is programmed and/or configured with appropriate hardware to perform that function.

Also included is a computing device (e.g., a general purpose computer) that is programmed and/or configured with appropriate hardware to perform that function via other algorithms as would be understood by one of ordinary skill in the art.

IX. Disclaimer

Numerous references to a particular embodiment do not indicate a disclaimer or disavowal of additional, different embodiments, and similarly references to the description of embodiments which all include a particular feature do not indicate a disclaimer or disavowal of embodiments which do not include that particular feature. A clear disclaimer or disavowal in the present application shall be prefaced by the phrase "does not include" or by the phrase "cannot perform".

X. Incorporation by Reference

Any patent, patent application or other document referred to herein is incorporated by reference into this patent application as part of the present disclosure, but only for purposes of written description and enablement in accordance with 35 U.S.C. §112, paragraph 1, and should in no way be used to limit, define, or otherwise construe any term of the present application, unless without such incorporation by reference, no ordinary meaning would have been ascertainable by a person of ordinary skill in the art. Such person of ordinary skill in the art need not have been in any way limited by any embodiments provided in the reference Any incorporation by reference does not, in and of itself, imply any endorsement of, ratification of or acquiescence in any statements, opinions, arguments or characterizations contained in any incorporated patent, patent application or other document, unless explicitly specified otherwise in this patent application.

XI. Prosecution History

In interpreting the present application (which includes the claims), one of ordinary skill in the art shall refer to the prosecution history of the present application, but not to the prosecution history of any other patent or patent application, regardless of whether there are other patent applications that are considered related to the present application, and regardless of whether there are other patent applications that share a claim of priority with the present application.

What is claimed is:

1. A method comprising:

accepting, by a computing device, bets from a first set of players to enter a competition that includes a maximum number of rounds;

conducting, by the computing device, successive rounds of the competition by, for each round by:

accepting, from remaining players in the competition, a respective choice of a respective winning participant of a respective single event on which a respective round is based, stopping acceptance of said choices from said remaining players at some point between a start of and an end of the respective single event, and determining one or more successful players to be those one or more players that correctly chose a winner of the respective single event, in which conducting the successive rounds includes continuing to conduct said successive rounds until at least one of: no players successfully choose a winner, only one player successfully chooses a winner, and the maximum number of rounds have been completed, and eliminating players from subsequent rounds of the successive rounds that did not successfully choose a winner; and awarding, by the computing device, a respective one of: players that successfully chose a winner of a prior to final successive round, the one player, and the remaining players after the maximum number of rounds have been completed.

2. The method of claim 1, in which accepting bets includes accepting buy ins into the competition.

3. The method of claim 1, comprising: allowing a player that has been eliminated from a prior round to buy into a later round by placing another bet.

4. The method of claim 1, comprising: determining an event for each round by selecting a recorded event from a library of recorded events.

5. The method of claim 1, in which selecting a recorded event includes determining desired difficulty level for a respective round and choosing a recorded event that has been tagged with that difficulty level.

6. The method of claim 1, in which each event includes a race.

7. The method of claim 1, in which each event includes a portion of a single race.

8. The method of claim 1, in which accepting a respective choice includes pausing a presentation of a respective event for a period of time so that players may enter choices and in which stopping acceptance includes resuming the presentation.

9. The method of claim 1, in which conducting successive rounds includes displaying an initial portion of a respective event prior to accepting the respective choices.

10. The method of claim 1, comprising pooling the bets together and awarding from the pool.

11. A method comprising:

accepting, by a computing device, buy-ins to a competition from each of a plurality of players, in which the competition is based on a plurality of rounds played individually by each of the plurality of players;

for a first player of the plurality of players in a first round of the plurality of rounds, determining, by the computing device, a recorded first event that is stored in an event library and is tagged with a difficulty level associated with the first round;

for a second player of the plurality of players in the first round of the plurality of rounds, determining, by the computing device, a recorded second event that is stored in the event library and is tagged with the difficulty level;

presenting, by the computing device, a first portion of the first event to the first player and a first portion of the second event to the second player;

after presenting the first portion of the first event and the first portion of the second event, receiving, by the computing device, a first selection of a winner in the first event from the first player and a second selection of a winner in the second event from the second player; and determining, by the computing device, whether the first player advances to a second round of the competition depending on whether the first selection is correct based on a second portion of the first event and whether the second player advances to a second round of the competition depending on whether the second selection is correct based on a second portion of the second event.

12. The method of claim 11, comprising: tagging each event in the event library with a difficulty level based on a closeness of event participants at the end of respective first portions of each event.

13. The method of claim 11, comprising: presenting the second portion of the first event to the first player and the second portion of the second event to the second player.

14. The method of claim 13, comprising: pausing the presentations of each of the first event and the second event between respective first portions and second portions, and requiring that the first player make the first selection while the presentation is paused and that the second player make the second selection while the presentation is paused.

15. The method of claim 13, in which the respective second portions are presented in response to receiving respective selections.

16. The method of claim 11, in which the first and second event include respective horse races.

17. The method of claim 11, comprising: obscuring presentation of the first portion of the first event and the first portion of the second event.

18. The method of claim 17, in which obscuring includes at least one of making an adjustment to a recording, a change to a color in a recording, and a change to a sound in a recording.

19. The method of claim 11, comprising: determining that the first and second players are in the same competition based on when a buy in is received from each of the first player and the second player so that the players are in the competition in response to submitting buy-ins at a similar time.

20. An apparatus comprising:

a computing device; and a non-transitory medium having stored thereon a plurality of instructions that cause the apparatus to:

accept bets from a first set of players to enter a competition that includes a maximum number of rounds;

conduct successive rounds of the competition by, for each round by:

accepting, from remaining players in the competition, a respective choice of a respective winning participant of a respective single event on which a respective round is based, stopping acceptance of said choices from said remaining players at some point between a start of and an end of the respective single event; and determining one or more successful players to be those one or more players that correctly chose a winner of the respective single event, in which conducting the successive rounds includes continuing to conduct said successive rounds until at least one of: no players successfully choose a winner, only one player successfully chooses a winner, and the maximum number of rounds have been completed, and eliminating players from subsequent rounds of the successive rounds that did not successfully choose a winner; and award a respective one of: players that successfully chose a winner of a prior to final successive round, the one player, and the remaining players after the maximum number of rounds have been completed.

21. An apparatus comprising:

a computing device; and a non-transitory medium having stored thereon a plurality of instructions that cause the apparatus to:

accept buy-ins to a competition from each of a plurality of players, in which the competition is based on a plurality of rounds played individually by each of the plurality of players;

for a first player of the plurality of players in a first round of the plurality of rounds, determine a recorded first event that is stored in an event library and is tagged with a difficulty level associated with the first round;

for a second player of the plurality of players in a first round of the plurality of rounds, determine a recorded second event that is stored in the event library and is tagged with the difficulty level;

present a first portion of the first event to the first player and a first portion of the second event to the second player;

after presenting the first portion of the first event and the first portion of the second event, receive a first selection of a winner in the first event from the first player and a second selection of a winner in the second event from the second player; and determine whether the first player advances to a second round of the competition depending on whether the first selection is correct based on a second portion of the first event and whether the second player advances to a second round of the competition depending on whether the second selection is correct based on a second portion of the second event.

22. The method of claim 1, in which conducting the successive rounds includes continuing to conduct said successive rounds until no players successfully choose a winner, and in which awarding includes awarding players that successfully chose the winner of the prior to final successive round, and in which the final successive round is a round less than the maximum number of rounds.

23. The method of claim 1, in which conducting the successive rounds includes continuing to conduct said successive rounds until only one player successfully chooses a winner in a round that is less than the maximum number of rounds, and in which awarding includes awarding the one player.

24. The method of claim 1, in which conducting the successive rounds includes continuing to conduct said successive rounds until the maximum number of rounds have been completed, and in which awarding includes awarding to the remaining players after the maximum number of rounds, in which the remaining players include a plurality of players.

* * * * *